US008421321B2

(12) United States Patent
Chuang

(10) Patent No.: US 8,421,321 B2
(45) Date of Patent: Apr. 16, 2013

(54) LED LIGHT BULB

(76) Inventor: Sheng-Yi Chuang, Hsinchu (TW)

( * ) Notice: Subject to any disclaimer, the term of this patent is extended or adjusted under 35 U.S.C. 154(b) by 64 days.

(21) Appl. No.: 13/149,179

(22) Filed: May 31, 2011

(65) Prior Publication Data

US 2012/0188775 A1 Jul. 26, 2012

Related U.S. Application Data

(63) Continuation-in-part of application No. 13/012,581, filed on Jan. 24, 2011, now Pat. No. 8,258,683.

(51) Int. Cl.
*F21V 29/00* (2006.01)
*H01J 7/24* (2006.01)

(52) U.S. Cl.
USPC ..... 313/46; 362/373

(58) Field of Classification Search ..... None
See application file for complete search history.

(56) References Cited

U.S. PATENT DOCUMENTS

| | | | | |
|---|---|---|---|---|
| 7,965,023 | B1 * | 6/2011 | Liang | 313/45 |
| 2010/0253200 | A1 * | 10/2010 | Osawa et al. | 313/46 |
| 2011/0101861 | A1 * | 5/2011 | Yoo | 315/35 |
| 2011/0109217 | A1 * | 5/2011 | Kang et al. | 313/46 |
| 2012/0007486 | A1 * | 1/2012 | Mora et al. | 313/46 |

FOREIGN PATENT DOCUMENTS

| | | |
|---|---|---|
| TW | I293807 | 2/2008 |
| TW | M345944 | 12/2008 |
| TW | M350675 | 2/2009 |
| TW | M358247 | 6/2009 |
| TW | M365440 | 9/2009 |
| TW | 201020457 | 6/2010 |
| TW | M381743 | 6/2010 |
| TW | I338106 | 3/2011 |

* cited by examiner

*Primary Examiner* — Ashok Patel
(74) *Attorney, Agent, or Firm* — Muncy, Geissler, Olds & Lowe, PLLC

(57) ABSTRACT

An LED light bulb includes a light transparent shell, a power receiving base, a heat sink and a coupling holder located between the light transparent shell and power receiving base, at least one light source baseboard held in the light transparent shell, and a power conversion board electrically connected to the light source baseboard and power receiving base. The heat sink has a housing chamber to hold the power conversion board and an annular coupling wall surrounded to form an area to couple with the light source baseboard. The light source baseboard has a contact surface on the circumference to form compact coupling with the coupling wall so that the light source baseboard is securely held on the heat sink without deforming at high temperature to provide improved heat conduction capability.

13 Claims, 7 Drawing Sheets

LED LIGHT BULB

This application is a continuation-in-part, and claims priority, of from U.S. patent application Ser. No. 13/012,581 filed on Jan. 24, 2011 now U.S. Pat. No. 8,258,683, entitled "INSULATION REINFORCING LIGHT BULB", the entire contents of which are hereby incorporated by reference.

FIELD OF THE INVENTION

The present invention relates to an LED light bulb and particularly to a light bulb with an LED baseboard and a heat sink coupled tightly.

BACKGROUND OF THE INVENTION

Light emitting diode (LED) provides many advantages such as longer lifespan, less power consumption, higher illumination and more eco-friendly materials. With advance of LED fabrication process and lower cost thereof, LED is not only adopted on traffic lights or indication lights of electric appliances, it also can be used on environmental decoration or lighting fixtures. In order to allow the LED to adapt to the general light bulb, some techniques have been proposed in prior art. For instance, R.O.C. patent No. I293807 entitled "LED light bulb equipped with a constant current circuit" discloses an LED light bulb which includes a lamp cap, a lamp shell, a plurality of LEDs coupled in series and a step-down constant current circuit. The lamp cap has electrodes connected to a power source. The LEDs are connected to the step-down constant current circuit which provides a constant current to let the LEDs emit light. The LED light bulb can be directly mounted onto a conventional lamp holder when in use. However, since driving the LEDs requires a steady DC current, waste heat will be constantly generated and accumulated when the driving circuit converts AC power into DC power. Moreover, the DC power passing through the impedance of LEDs also generates a lot of waste heat. All these result in overhigh temperature after long-term use that could damage the LEDs or driving circuit, or shorten the lifespan thereof.

To remedy the aforesaid problem, many types of LED light bulbs equipped with heat dissipation structure have been developed. For instance, R.O.C. patent No. I338106 entitled "LED lamp set" discloses an LED lamp set which includes a light emission device containing an LED unit, a circuit board to drive and control the LED unit, and an internal lens. The circuit board is held in a second housing chamber of a metal lamp cup. The LED unit is held in a first housing chamber of the metal lamp cup and has a heat conductive baseboard and a high power LED chip mounted onto the baseboard. The drawings of this prior art show that the baseboard holding the high power LED chip is fastened to the metal lamp cup via a plurality of screws. The baseboard is held merely via these screws.

R.O.C. patent No. M350675 entitled "LED lamp set and shade structure of the same" discloses an LED lamp set that includes a latchable radiation fin set and an LED module. The latchable radiation fin set surrounds a housing chamber inside. The LED module is held in the housing chamber and connected to the radiation fin set. The drawings of this prior art show that the LED module has a circuit board fastened to the radiation fin set via screws.

Another R.O.C. patent No. M365440 also discloses a technique to fasten the LED baseboard via screws.

However, the aforesaid techniques of fastening the LED baseboard via the screws have many disadvantages. Please refer to FIGS. 1 and 2 for a conventional LED light bulb which includes a lamp shell 90, an LED baseboard 91, a heat sink 92, a power conversion board 93 and a power receiving base 94. The heat sink 92 has one end fastened to the power receiving base 94. The power conversion board 93 is interposed between the heat sink 92 and power receiving base 94. The heat sink 92 has a holding surface 921 at another end, a plurality of first screw holes 922 on the holding surface 921 and a wiring bore 923 running through the holding surface 921. The LED baseboard 91 holds a plurality of LEDs 911 and has a plurality of second screw holes 912 corresponding to the first screw holes 922. A plurality of screws 95 are provided to run through the screw holes 912 and 922 to fasten the LED baseboard 91 to the holding surface 921 of the heat sink 92. But such a structure also creates problems. For instance, if the LED baseboard 91 is fastened to the heat sink 92 via the screws 95, only the circumference of the screws 95 can be fully attached to the heat sink 92. Moreover, since the LED baseboard 91 is made of aluminum, it is easily to be deformed during heating of the LEDs 911 that are held on the LED baseboard 91 The drawings merely illustrate the deformation in a schematic manner. In practice, different deformed conditions occur due to different materials and temperatures. The deformation causes some portions spaced from the screws 95 cannot tightly contact with the heat sink 92 due to heat expansion and cold shrinkage. As a result, heat conduction speed between the LED baseboard 91 and heat sink 92 drops drastically, and the temperature of the LED baseboard 91 rises faster that causes even more obvious deformed condition. Hence a vicious cycle of poor cooling takes place.

SUMMARY OF THE INVENTION

In view of the conventional LED light bulb using screws to fasten the LED baseboard by a simple technique but increasing working time and causing deformation of the LED baseboard due to temperature rising to decrease heat conduction effect between the LED baseboard and heat sink and result in a vicious cycle of poor cooling, the present invention aims to provide an LED light bulb that includes a light transparent shell, a power receiving base, a heat sink and a coupling holder located between the light transparent shell and power receiving base, at least one light source baseboard located in the light transparent shell, and a power conversion board electrically connected to the light source baseboard and power receiving base. The heat sink has a housing chamber to hold the power conversion board and also an annular coupling wall to couple with the light source baseboard. The light source baseboard has a contact surface on the circumference corresponding and fastening to the coupling wall to form compact coupling so that the light source baseboard is held tightly on the heat sink to prevent deformation caused by temperature. The compact coupling between the light source baseboard and heat sink also provides improved heat conduction effect.

Moreover, the LED light bulb of the invention further includes an isolation member held in the housing chamber. The isolation member has an isolation wall interposed between the power conversion board and heat sink to form a circuit holding compartment to hole the power conversion board, and a wiring outlet formed on the isolation wall to allow wires of the power conversion board to pass through to connect the power conversion board with the light source baseboard. The isolation wall isolates the power conversion board to pass severe safety regulation tests.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
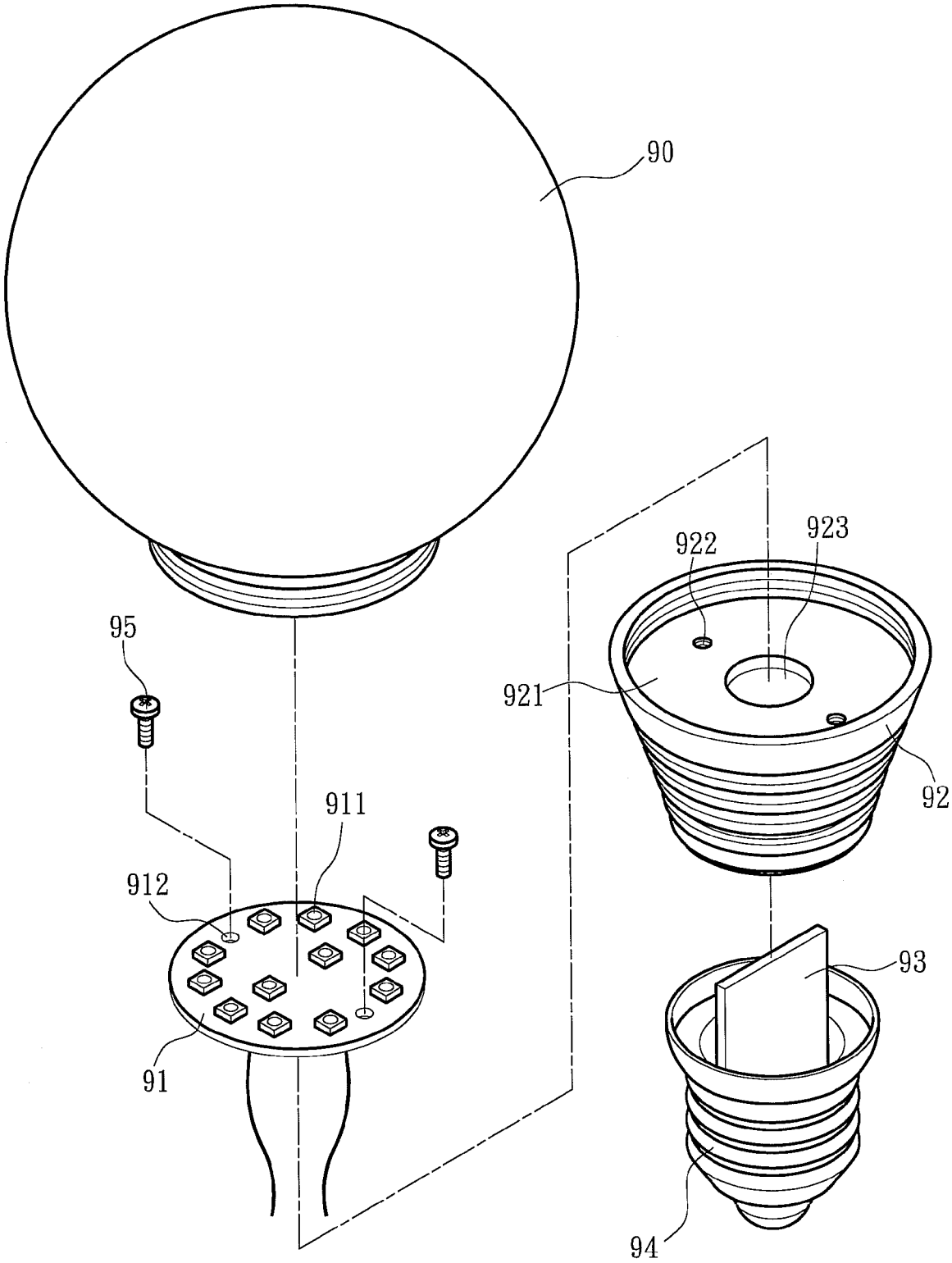
Fig. 1 PRIOR ART
FIG. 1 is an exploded view of a conventional light bulb.
Figure 2:
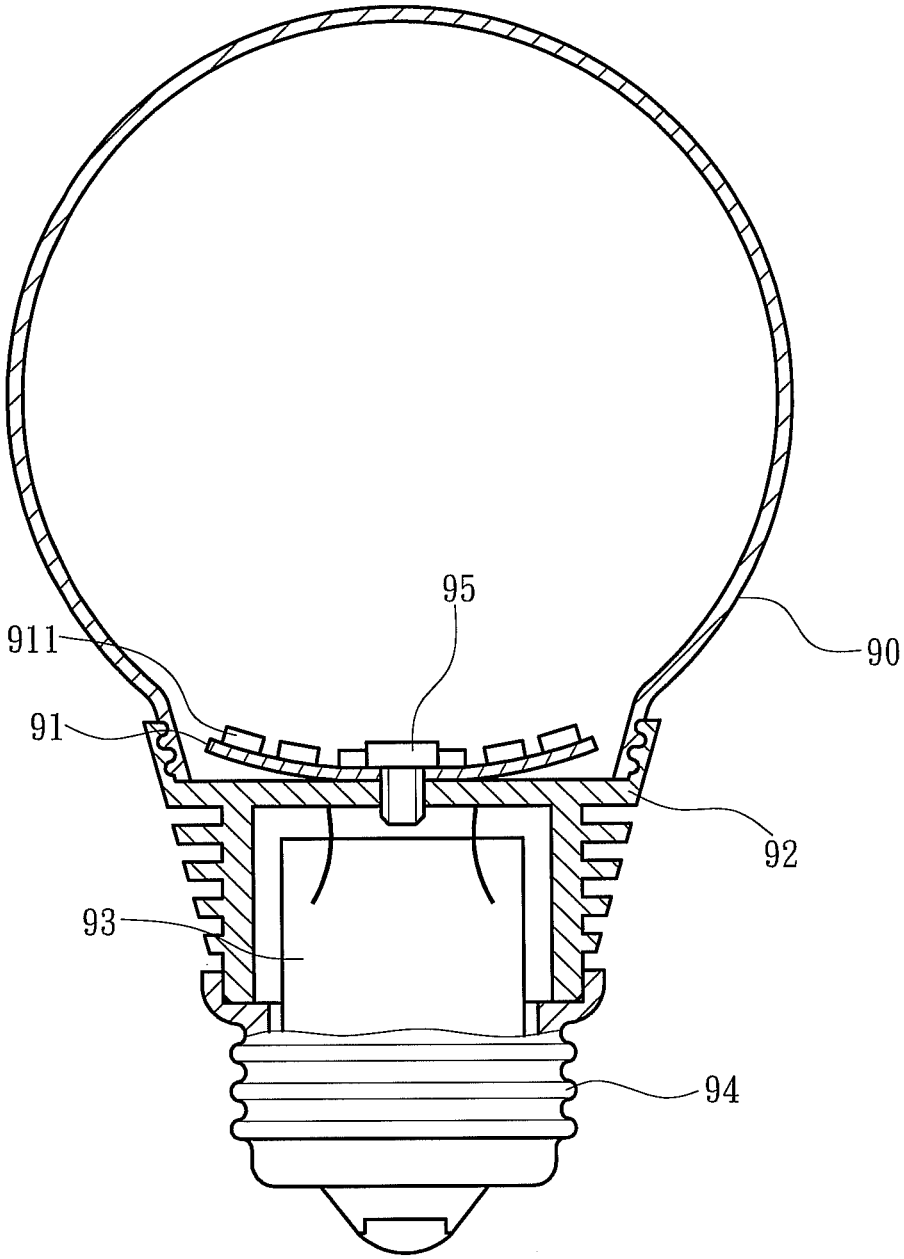
Fig. 2 PRIOR ART
FIG. 2 is a sectional view of a conventional light bulb.

The present invention aims to provide an LED light bulb. Please refer to FIGS. 3A through 5 for a first embodiment of the invention. The LED light bulb includes a light transparent shell 5, a power receiving base 6, a heat sink 4 and a coupling holder 2 located between the light transparent shell 5 and power receiving base 6, at least one light source baseboard 40 located in the light transparent shell 5, and a power conversion board 3 electrically connected to the light source baseboard 40 and power receiving base 6. The power conversion board 3 is preferably a switch-type power circuit. The heat sink 4 has a housing chamber 41 to hold the power conversion board 3. The light source baseboard 40 holds a plurality of LEDs 401, and can be an aluminum baseboard containing a plurality of conductive wires. Based on present techniques, the aluminum baseboard can be formed by stacking a copper foil, conductive insulation material and an aluminum plate over one another. The copper foil is etched to form circuits, and then is encased by the conductive insulation material and aluminum plate to become the light source baseboard 40 with the conductive wires embedded inside. Fabrication of the aluminum baseboard is a technique known in the art and not a key feature of the invention, thus details are omitted herein. In order to provide more desirable positioning of the light source baseboard 40, the heat sink 4 has an annular coupling wall 410 to form an area to surround and hold the light source baseboard 40. The light source baseboard 40 has a contact surface 400 on the circumference. Through pressing the light source baseboard 40 into the area surrounded by the coupling wall 410, the contact surface 400 is tightly in contact with the corresponding coupling wall 410 to form compact coupling so that the light source baseboard 40 can be securely held on the heat sink 4. More specifically, the contact surface 400 is formed at an outer diameter no less than the inner diameter of the coupling wall 410 to allow the light source baseboard 40 to be squeezed onto the coupling wall 410. The coupling wall 410 is slightly elastic and has desired hardness to form compact coupling between the coupling wall 410 and contact surface 400. The heat sink 4 further has a support portion 412 below the light source baseboard 40 to form a thickness difference with the coupling wall 410 to brace the light source baseboard 40. By means of the aforesaid technique of tightly coupling the light source baseboard 40 with the heat sink 4, a desired heat conduction effect can be accomplished. Moreover, when the temperature of the light source baseboard 40 rises, the compact coupling between the contact surface 400 and the coupling wall 410 can prevent the light source baseboard 40 from deforming to increase the heat conduction effect. Therefore, the shortcomings of the conventional screw fastening can be improved.

Figure 3A:
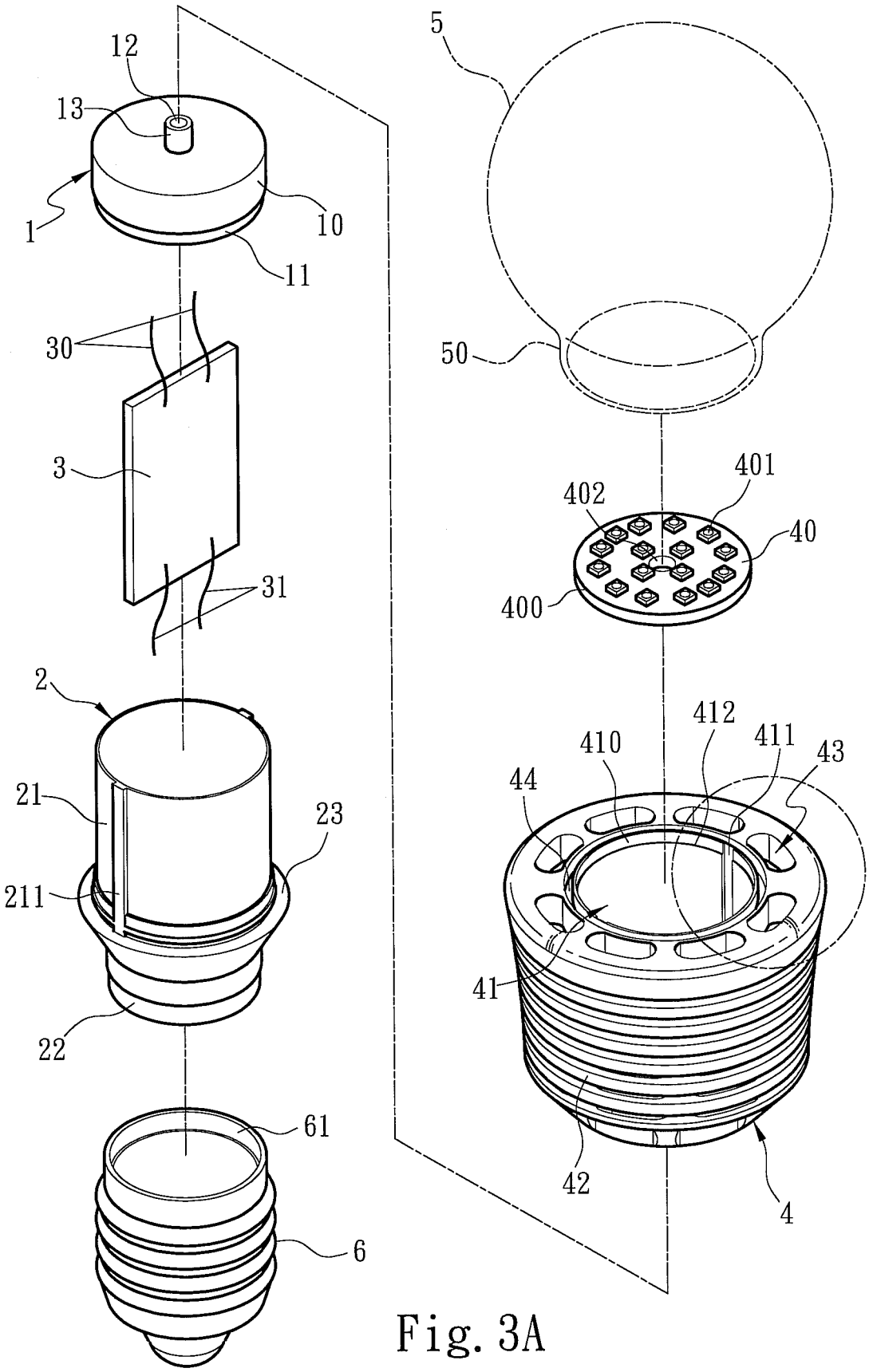
FIG. 3A is an exploded view of the LED light bulb of the invention.
Figure 3B:
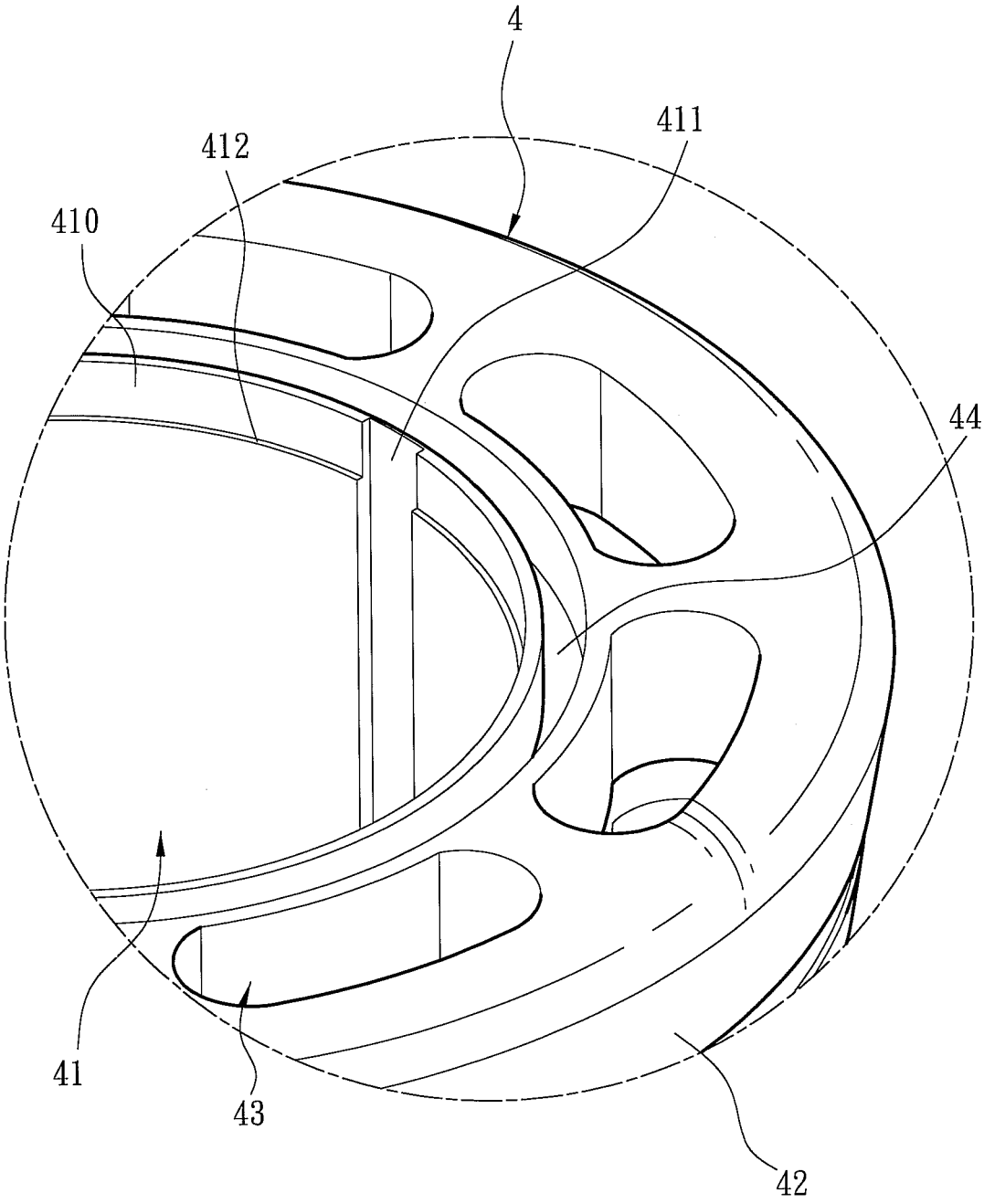
FIG. 3B is a fragmentary enlarged view of the heat sink of the invention.
Figure 4:
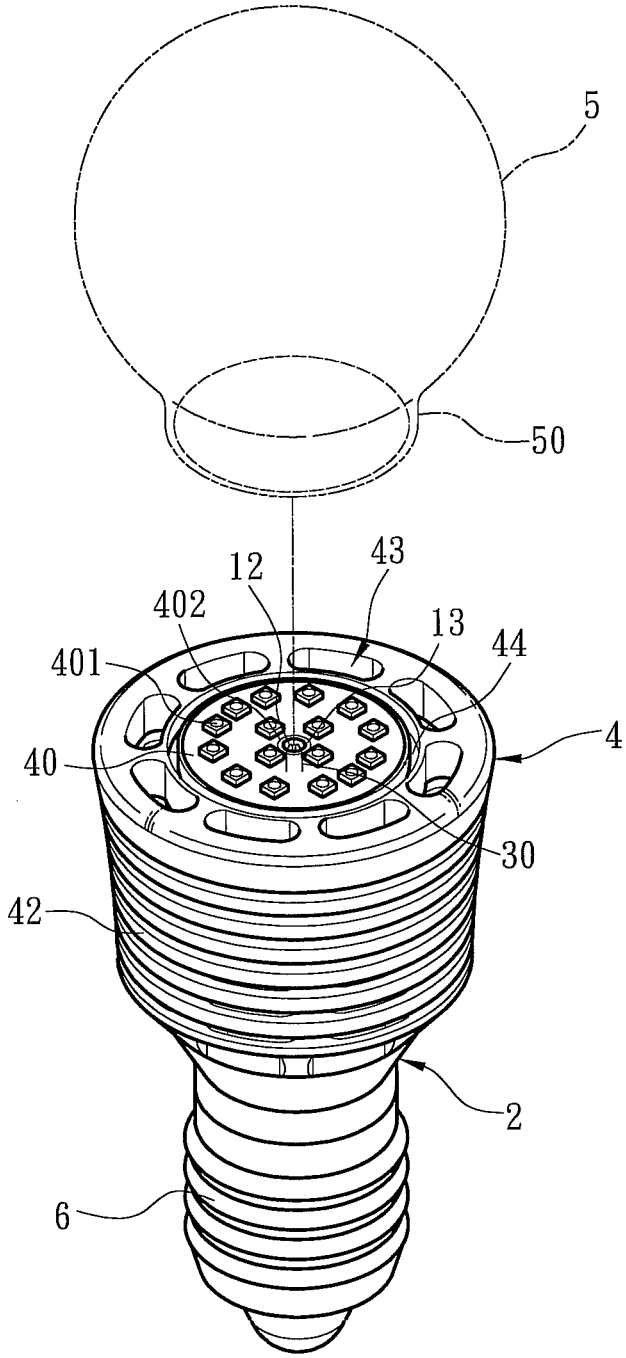
FIG. 4 is a schematic view of the LED light bulb in an assembling condition.
Figure 5:
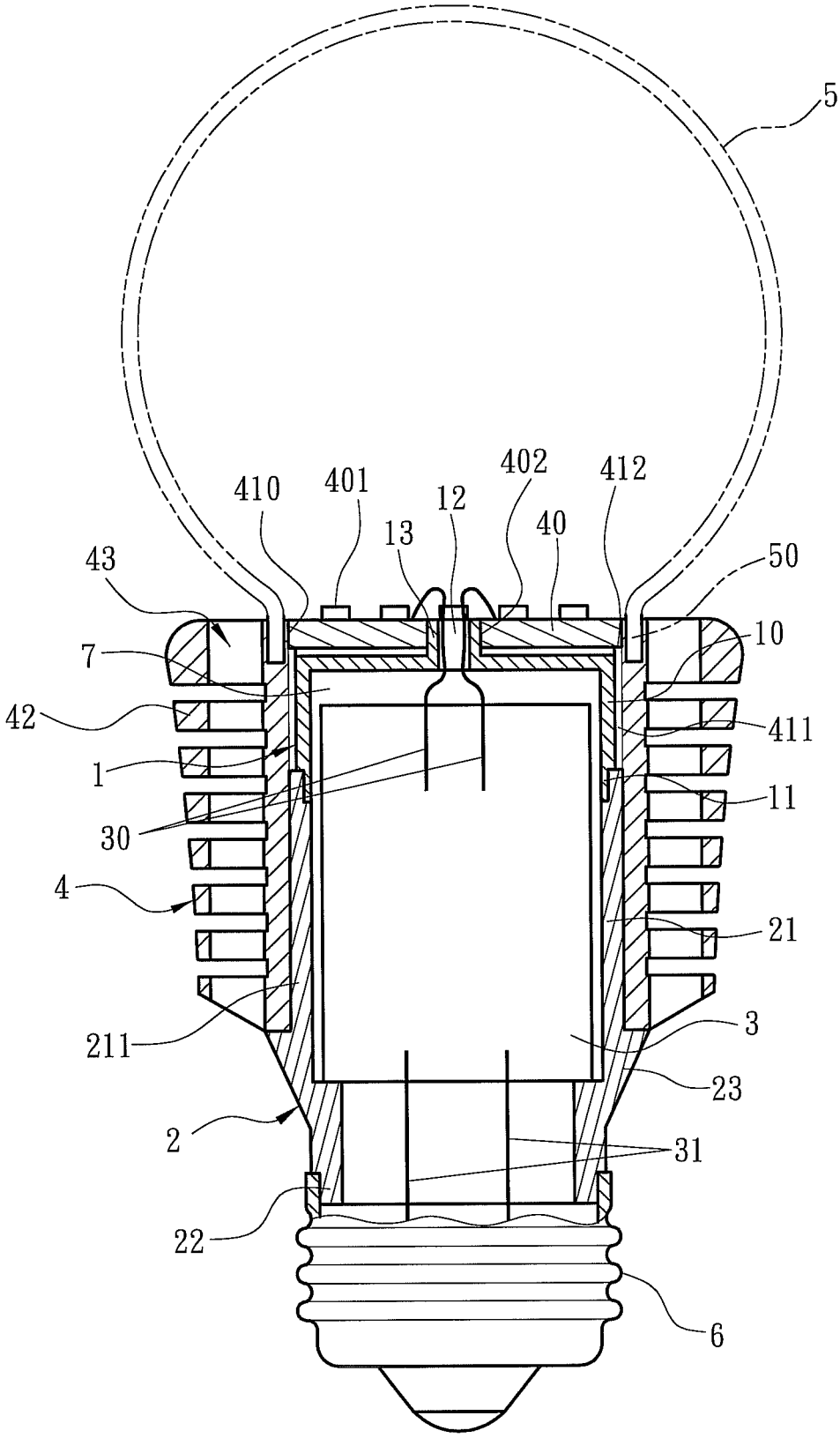
FIG. 5 is a sectional view of the LED light bulb of the invention.

In order to pass the safety regulation tests, the coupling holder 2 further has an insulation wall 21 surrounded to form a circuit holding compartment 7 to hold the power conversion board 3, a mask portion 23, and a fastening portion 22. The insulation wall 21 is located between the power conversion board 3 and heat sink 4. The mask portion 23 attaches to a lower side of the heat sink 4 to seal an opening at the lower end of the housing chamber 41. In order to form tight coupling between the coupling holder 2 and heat sink 4, the coupling holder 2 has a first holding portion 211 and the heat sink 4 has at least one second holding portion 411 at the inner side corresponding to and latching with the first holding portion 211 to restrict the coupling holder 2 from moving against the heat sink 4. The first holding portion 211 can be a longitudinal bump, a transverse bump, or a longitudinal bump and a transverse bump staggered with each other (as shown in FIG. 3A), while the second holding portion 411 is a notch corresponding to and latching with the first holding portion 211. The bump and notch mentioned above for the first and second holding portions 211 and 411 merely are embodiment examples, various latching alternatives and alterations of the first and second holding portions 211 and 411 should be included within the scope of the invention. To further improve insulation to protect the power conversion board 3, the LED light bulb may include an isolation member 1 that contains an isolation wall 10 interposed between the power conversion board 3 and heat sink 4, and a wiring outlet 12 located on the isolation wall 10 to allow wires of the power conversion board 3 to pass through to connect the power conversion board 3 with the light source baseboard 40. In order to pass the safety regulation tests, the isolation member 1 has a protruding portion 13 to surround the wiring outlet 12 to prevent piercing by high voltage electric power. As shown in the embodiment in FIG. 3A, the isolation wall 10 has a coupling portion 11 at a distal end to couple with the upper end of the coupling holder 2 so that the isolation wall 10 surrounds and covers the upper side and lateral side of the power conversion board 3 and seals the upper opening of the coupling holder 2. By coupling the coupling holder 2 with the isolation member 1, the power conversion board 3 is isolated and insulated in the circuit holding compartment 7.

The light source baseboard 40 further has a wiring bore 402 communicating with the housing chamber 41. The power conversion board 3 has at least one power cord 30 connected thereto to pass through the wiring outlet 12 and wiring bore 402 to form electrical connection between the power conversion board 3 and LEDs 401. The protruding portion 13 may be wedged in the wiring bore 402.

Through the technique previously discussed, the power conversion board 3 can be held in the LED light bulb and isolated and protected in the circuit holding compartment 7 via the isolation member 1 and coupling holder 2. Furthermore, the isolation wall 10 and the heat sink 4 are spaced from each other by a gap to protect the power conversion board 3 from being damaged during the high voltage test in the safety regulation tests.

Also referring to FIGS. 3A through 5, the fastening portion 22 of the coupling holder 2 is located outside the housing chamber 41 and coupled with a fastening end 61 of the power receiving base 6 to connect to an external power source. Through at least one power cord 31 to form electrical connection between the power conversion board 3 and power receiving base 6, the power from the external power source is sent to the power conversion board 3. Depending on various types or application environments of the light bulb, varying power receiving bases 6 can be selected. FIGS. 3A through 5 illustrate an embodiment adopting a general household light bulb, but this is not the limitation of the power receiving base 6.

The heat sink 4 also has a holding groove 44 located outside the coupling wall 410 to hold the light transparent shell 5. The light transparent shell 5 has a neck 50 tightly wedged in the holding groove 44. Adhesive or a latch mechanism may also be incorporated to bond the neck 50 in the holding groove 44.

Figure 6:
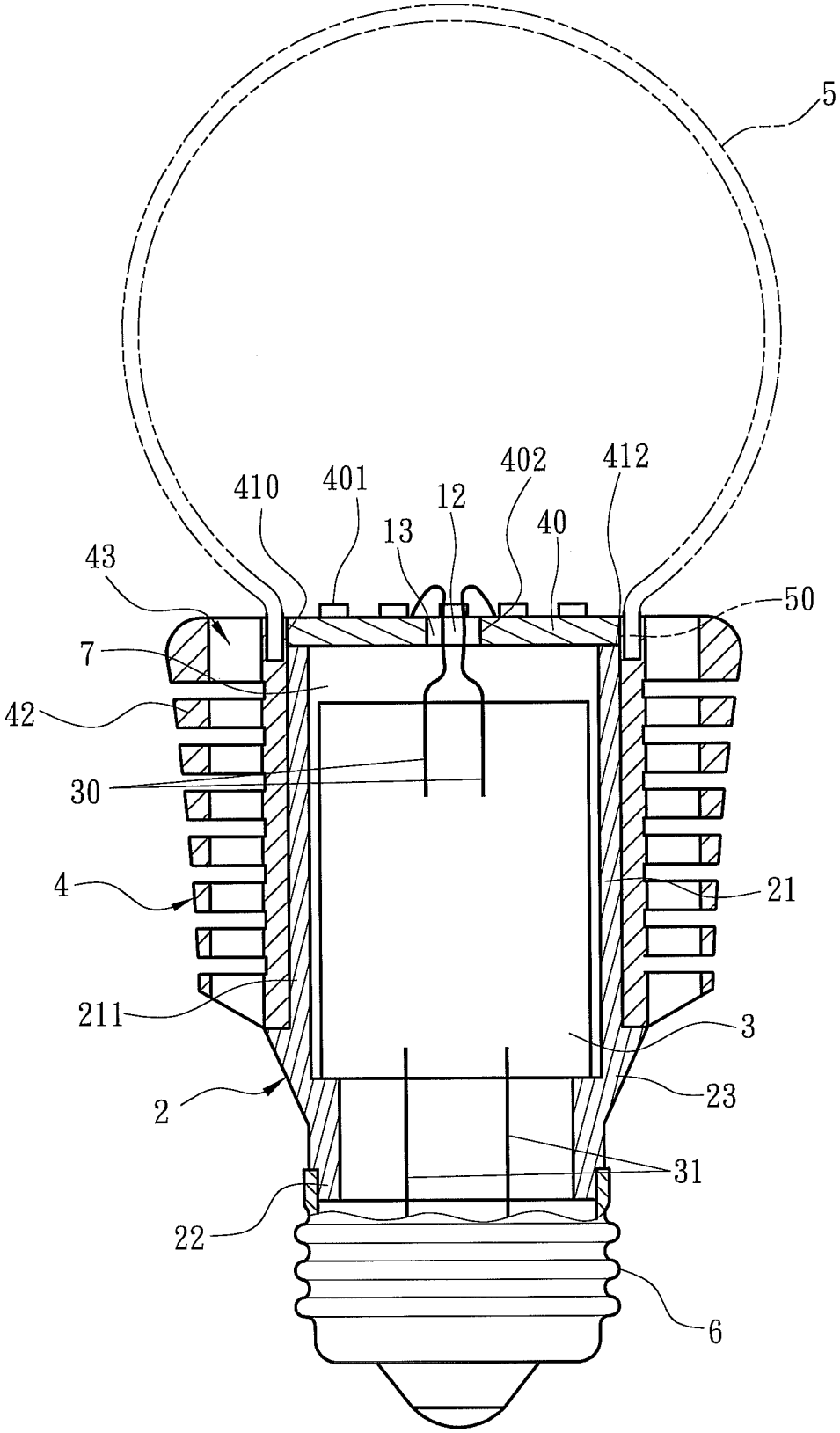
FIG. 6 is a sectional view of another embodiment of the invention showing that the isolation member and coupling holder are tightly coupled.

Refer to FIG. 6 for another embodiment of the LED light bulb. It differs from the first embodiment by not installing the isolation member 1. In this embodiment, the insulation wall 21 of the coupling holder 2 is extended upwards to connect to the light source baseboard 40, and the power cord 30 of the power conversion board 3 directly passes through the upper opening of the coupling holder 2 and wiring bore 402 to electrically connect to the light source baseboard 40. The insulation wall 21 fully isolates the power conversion board 3 and heat sink 4, thus provides desired insulation to pass the safety regulation tests.

In the first embodiment shown in FIGS. 3A through 5 and second embodiment shown in FIG. 6, the heat sink 4 has a plurality of radiation fins 42 located on the outer side and stacked over one another. The radiation fins 42 are spaced from one another by gaps to facilitate air circulation. The radiation fins 42 also have a plurality of vents 43 formed thereon and arranged to form at least one longitudinal airflow passage running through the heat sink 4 to allow air to pass through. The gaps between the radiation fins 42 and the airflow passage provide air circulation in transverse and longitudinal directions, and also increase contact area with the air to achieve desired cooling effect.

While the invention has been described by means of specific embodiments, numerous modifications and variations could be made thereto by those skilled in the art without departing from the scope and spirit of the invention set forth in the claims.

In summation of the above description, the present invention provides a significant improvement over the conventional techniques and complies with the patent application requirements, and is submitted for review and granting of the commensurate patent rights.

What is claimed is:

1. An LED light bulb, comprising a light transparent shell, a power receiving base, a heat sink and a coupling holder located between the light transparent shell and the power receiving base, at least one light source baseboard located in the light transparent shell, and a power conversion board electrically connected to the light source baseboard and the power receiving base, the heat sink including a housing chamber to hold the power conversion board, wherein:

the heat sink includes an annular coupling wall to form an area to couple with the light source baseboard, the light source baseboard including a contact surface on the circumference corresponding to the coupling wall to form compact coupling therewith to hold the light source baseboard securely on the heat sink, wherein the coupling holder includes an insulation wall surrounded to form a circuit holding compartment to hold the power conversion board, and a mask portion attached to a lower side of the heat sink to seal an opening at a lower end of the housing chamber, the LED light bulb further including an isolation member held in the housing chamber, the isolation member including an isolation wall interposed between the power conversion board and the heat sink, and a wiring outlet to allow wires of the power conversion board to pass through to connect the power conversion board with the light source baseboard, the insulation wall including an inner rim to form compact coupling with the isolation wall.

2. The LED light bulb of claim 1, wherein the light source baseboard is formed at an outer diameter no less than an inner diameter of the coupling wall.

3. The LED light bulb of claim 1, wherein the heat sink includes a support portion below the light source baseboard to form a thickness difference with the coupling wall to brace the light source baseboard.

4. The LED light bulb of claim 1, wherein the heat sink includes a plurality of radiation fins stacked over one another, the radiation fins including a plurality of vents formed thereon to form at least one airflow passage.

5. The LED light bulb of claim 1, wherein the power conversion board is a switch-type power circuit.

6. The LED light bulb of claim 1, wherein the coupling holder and the heat sink include respectively a first holding portion and a second holding portion corresponding to and latching with each other.

7. The LED light bulb of claim 6, wherein the first holding portion is a notch and the second holding portion is a bump corresponding to and latching with each other.

8. The LED light bulb of claim 1, wherein the coupling holder includes a fastening portion located outside the housing chamber to fasten to the power receiving base.

9. The LED light bulb of claim 1, wherein the isolation member includes a protruding portion to surround the wiring outlet.

10. The LED light bulb of claim 9, wherein the light source baseboard includes a wiring bore communicating with the housing chamber to allow at least one power cord to pass through to form electrical connection with the light source baseboard.

11. The LED light bulb of claim 10, wherein the protruding portion is wedged in the wiring bore of the light source baseboard.

12. The LED light bulb of claim 1, wherein the light source baseboard includes a wiring bore communicating with the housing chamber to allow at least one power cord to pass through to form electrical connection with the light source baseboard.

13. The LED light bulb of claim 1, wherein the light source baseboard is an aluminum baseboard including a plurality of conductive wires.

* * * * *